US010819056B2

(12) United States Patent
Kitaoka

(10) Patent No.: US 10,819,056 B2
(45) Date of Patent: Oct. 27, 2020

(54) FEMALE TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kenichi Kitaoka, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/604,991

(22) PCT Filed: Apr. 9, 2018

(86) PCT No.: PCT/JP2018/014879
§ 371 (c)(1),
(2) Date: Oct. 11, 2019

(87) PCT Pub. No.: WO2018/190288
PCT Pub. Date: Oct. 18, 2018

(65) Prior Publication Data

US 2020/0161787 A1 May 21, 2020

(30) Foreign Application Priority Data

Apr. 14, 2017 (JP) ..... 2017-080527

(51) Int. Cl.
*H01R 4/48* (2006.01)
*H01R 13/115* (2006.01)
*H01R 13/11* (2006.01)

(52) U.S. Cl.
CPC ..... *H01R 13/115* (2013.01); *H01R 13/113* (2013.01)

(58) Field of Classification Search
CPC ..... H01R 4/18; H01R 13/115; H01R 13/113; H01R 13/055; H01R 13/187
(Continued)

(56) References Cited

U.S. PATENT DOCUMENTS 6,290,553 B1 * 9/2001 Sato ..... H01R 13/187 439/843
7,985,106 B2 * 7/2011 Sugiyama ..... H01R 13/113 439/852
(Continued)

FOREIGN PATENT DOCUMENTS

JP 56-75483 6/1981
JP 1-106083 7/1989
(Continued)

OTHER PUBLICATIONS

International Search Report dated Jun. 12, 2018.

*Primary Examiner* — Jean F Duverne
(74) *Attorney, Agent, or Firm* — Gerald E. Hespos; Michael J. Porco; Matthew T. Hespos

(57) ABSTRACT

A female terminal (10) includes a female body (11) having a ceiling wall (12) and a bottom wall (15) facing each other. First contact pressure applying portions (20) apply a contact pressure by contacting a male terminal from the side of the ceiling wall (12), and second contact pressure applying portions (30) apply a contact pressure by contacting the male terminal from the side of the bottom wall (15). First contact portions (21) of the first contact pressure applying portions (20) and second contact portions of the second contact pressure applying portions (30) are shifted from each other in the front-rear direction. The contact pressure applied by
(Continued)

the first contact pressure applying portions (20) is lower than the contact pressure applied by the second contact pressure applying portions (30).

6 Claims, 9 Drawing Sheets

(58) Field of Classification Search
USPC ..... 439/834
See application file for complete search history.

(56) References Cited

U.S. PATENT DOCUMENTS

| | | | | |
|---|---|---|---|---|
| 7,988,505 | B2 * | 8/2011 | Hotea | H01R 13/187 439/852 |
| 8,152,576 | B2 * | 4/2012 | Nakamura | H01R 13/055 439/852 |
| 9,960,516 | B2 * | 5/2018 | Onuma | H01R 13/115 |
| 10,230,178 | B2 * | 3/2019 | Droesbeke | H01R 4/18 |
| 2001/0051472 | A1 | 12/2001 | Sato et al. | |
| 2012/0156947 | A1 * | 6/2012 | Tyler | H01R 13/113 439/842 |

FOREIGN PATENT DOCUMENTS

| | | |
|---|---|---|
| JP | 2002-63961 | 2/2002 |
| JP | 2014-53205 | 3/2014 |
| JP | 2014-232576 | 12/2014 |
| JP | 2015-84310 | 4/2015 |

* cited by examiner

FEMALE TERMINAL

BACKGROUND

Field of the Invention

This specification relates to a female terminal.

Related Art

Japanese Unexamined Patent Publication No. 2014-53205 discloses a female terminal formed by press-working and bending a plate. Further, plating is applied to the processed female terminal. The female terminal includes a rectangular tubular box into which a male tab terminal is inserted. A conductor crimping portion is provided behind the box and is to be crimped to a conductor of a wire. A leaf spring is provided on an upper wall inside the box and resiliently contacts the male tab terminal. A tab receiving portion is provided on a lower wall inside the box and contacts the male tab terminal.

The male tab terminal is formed by press-working and bending a plate. Further, plating is applied to the processed male tab terminal. The male tab terminal includes a bar-shaped male body.

The male body that is inserted into the box of the female terminal is sandwiched between the leaf spring and the tab receiving portion. In this way, the male tab terminal and the female terminal resiliently contact and are connected electrically.

When the male tab terminal is inserted into the box of the female terminal, the male body of the male tab terminal is inserted while being resiliently pressed by the leaf spring inside the box. Thus, the plating applied to the female terminal is worn at a contact portion between the male tab terminal and the female terminal. If the male tab terminal needs to be inserted and withdrawn many times, the wear of the plating increases. To prevent such wear of the plating, it is generally necessary to lower a contact pressure of the leaf spring of the female terminal. However, if the contact pressure of the leaf spring of the female terminal is lowered, the connection reliability of the terminals is reduced and a connection failure of the terminals easily occurs due to vibration or the like.

SUMMARY

A female terminal disclosed in this specification is includes a box-shaped female body that is open in a front-rear direction. The female terminal has a ceiling wall and a bottom wall facing each other in a vertical direction. A male terminal is inserted into the female body portion. A first contact pressure applying portion is provided between the ceiling wall and the bottom wall of the female body and is configured to apply a contact pressure by contacting the male terminal from the ceiling wall side. A second contact pressure applying portion is provided at a position facing the first contact pressure applying portion in the vertical direction and is configured to apply a contact pressure by contacting the male terminal from the bottom wall side. A first contact portion is defined where the first contact pressure applying portion and the male terminal are in contact, and a second contact portion is defined where the second contact pressure applying portion and the male terminal are in contact. The first and second contact portions are shifted from each other in the front-rear direction. Additionally, the contact pressure applied to the male terminal by the first contact pressure applying portion is lower than the contact pressure applied to the male terminal by the second contact pressure applying portion.

The contact pressure applied to the male terminal by the second contact pressure applying portion from the bottom wall side inside the female body can be a high contact pressure and the contact pressure applied to the male terminal by the first contact pressure applying portion from the ceiling wall side inside the female body can be a low contact pressure.

The high contact pressure keeps electrical connection at the contact portion between the male terminal and the female terminal when vibration or the like is applied to the fit male terminal and female terminal. If the male terminal is inserted into or withdrawn from the female terminal with such a high contact pressure applied to the male terminal, plating applied to the contact portion between the male terminal and the female terminal is worn. On the other hand, the low contact pressure is lower than the high contact pressure and does not cause the wear of the plating applied to the female terminal at the contact portion between the male terminal and the female terminal even if the male terminal is inserted into or withdrawn from the female terminal.

The plating applied to the female terminal at the second contact portion is worn where the second contact pressure applying portion applies the high contact pressure to the male terminal. However, this area is affected less by vibration and the like and a connection failure between the male and female terminals is less likely to occur. On the other hand, at the first contact portion where the first contact pressure applying portion for applying the low contact pressure and the male terminal are in contact, the wear of the plating applied to the female terminal can be prevented. Thus, conduction can be ensured while the wear of the plating due to the insertion and withdrawal of the male terminal many times is prevented. Therefore, the connection reliability of the terminals is ensured while the wear of the plating is allowed at the second contact pressure applying portion for applying the high contact pressure, and the wear of the plating is prevented and conduction is ensured even if the male terminal is inserted into and withdrawn from the female terminal many times at the first contact pressure applying portion for applying the low contact pressure.

Two first contact pressure applying portions and two second contact pressure applying portions may be disposed in a direction intersecting an inserting direction of the male terminal. Additionally, the female terminal may include third and fourth contact pressure applying portion. The third contact pressure applying portion may be provided between the adjacent first contact pressure applying portions and may be configured to apply a contact pressure by contacting the male terminal from the ceiling wall side. The fourth contact pressure applying portion may be provided at a position facing the third contact pressure applying portion in the vertical direction and may be configured to apply a contact pressure by contacting the male terminal from the bottom wall side. A third contact portion is defined where the third contact pressure applying portion and the male terminal are in contact, and a fourth contact portion is defined where the fourth contact pressure applying portion and the male terminal are in contact. The third and fourth contact portions may be shifted from each other in the front-rear direction. The contact pressure applied to the male terminal by the third contact pressure applying portion may be higher than the contact pressure applied to the male terminal by the fourth contact pressure applying portion. With this configuration, the high contact pressure is applied to the male terminal by the two second contact pressure applying portions from the bottom wall side and the high contact pressure is applied to the male terminal by the one third contact pressure applying portion from the ceiling wall side.

For example, a male terminal may be allowed to rattle inside a male housing to facilitate the fitting of the male terminal and the female terminal. If the male terminal is allowed to rattle and there are only two first contact pressure applying portions for applying a low contact pressure and the second contact pressure applying portion for applying a high contact pressure, then the male terminal that rattles in the male housing and would displace toward the ceiling wall. In this situation, the male terminal and the first contact pressure applying portion for applying the low contact pressure would slide in contact with each other at the high contact pressure when the male terminal passes the second contact portion of the second contact pressure applying portion for applying the high contact pressure. In this way, the plating of the first contact pressure applying portion would be worn.

However, by applying the high contact pressure not only from the ceiling wall side, but also from the bottom wall side as described above, the male terminal can be inserted into and withdrawn from the female body without the plating of the first contact pressure applying portion being worn even if the male terminal rattles.

The second contact pressure applying portion may include a second vertical piece vertically extending from the second contact portion toward the bottom wall, and an end surface of the second vertical piece may contact the bottom wall by insertion of the male terminal. With this configuration, the second contact portion of the second contact pressure applying portion in contact with the male terminal is displaced toward the bottom wall when the male terminal is inserted into the female body. Associated with that, the second vertical piece of the second contact pressure applying portion also is displaced toward the bottom wall and the end surface of the second vertical piece comes into contact with the bottom wall. However, the second vertical piece vertically extends from the second contact portion toward the bottom wall and hardly deflects. Thus, if the second vertical piece contacts the bottom wall, the second contact portion is hardly displaced toward the bottom wall. Therefore, the second contact pressure applying portion can apply the high contact pressure to the male terminal.

The third contact pressure applying portion may include a third vertical piece vertically extending from the third contact portion toward the ceiling wall, and an end surface of the third vertical piece may contact the ceiling wall by insertion of the male terminal. Thus, the third contact pressure applying portion can apply the high contact pressure to the male terminal similar to the aforementioned second contact pressure applying portion.

According to the female terminal disclosed in this specification, the connection reliability of the terminals can be ensured while anti-vibration measures are taken.

DETAILED DESCRIPTION

An embodiment is described with reference to FIGS. 1 to 9.

Figure 1:
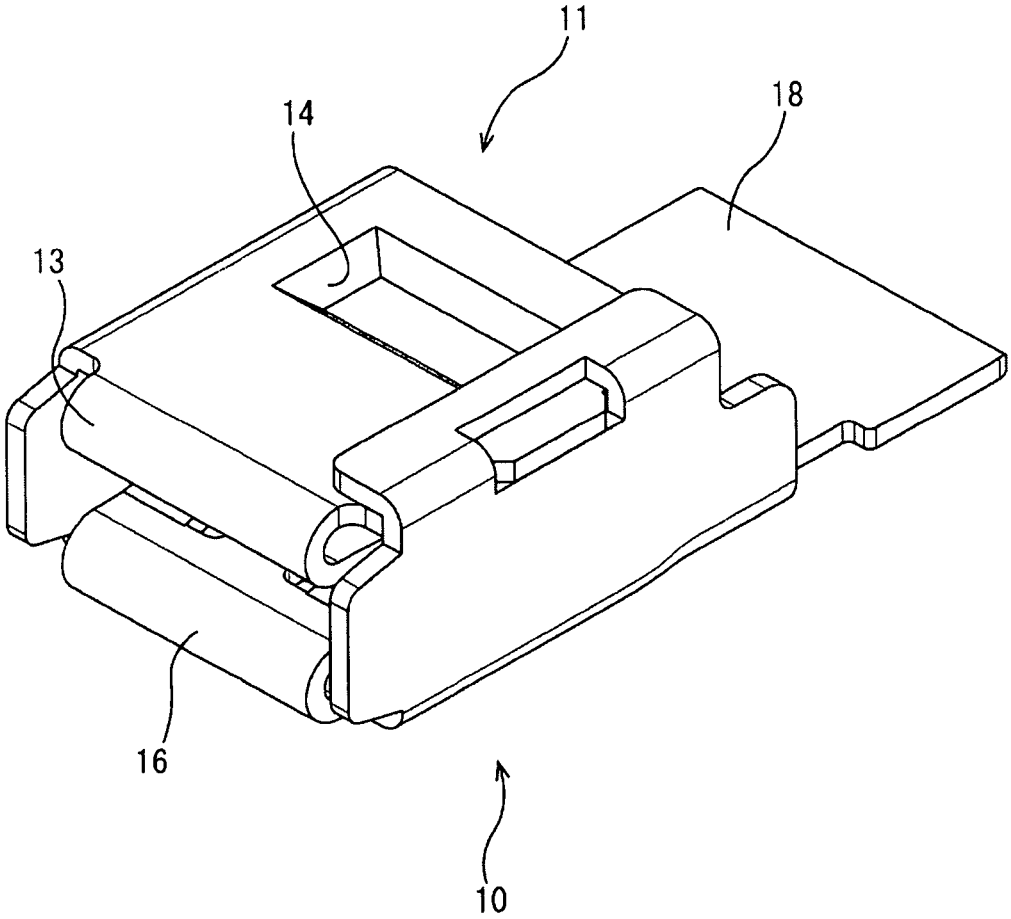
FIG. 1 is a perspective view of a female terminal in an embodiment.

A female terminal 10 of this embodiment is formed by stamping and bending a copper plate. Further, plating of silver or the like is applied to the processed female terminal 10. As shown in FIG. 1, the female terminal 10 includes a female body 11 and a wire connecting portion 18 provided behind the female body 11. The female terminal 10 is fit to a male terminal M.

The male terminal M is plate-like and formed such as by stamping a plate. Further, plating of silver or the like is applied to the processed male terminal M.

Figure 5:
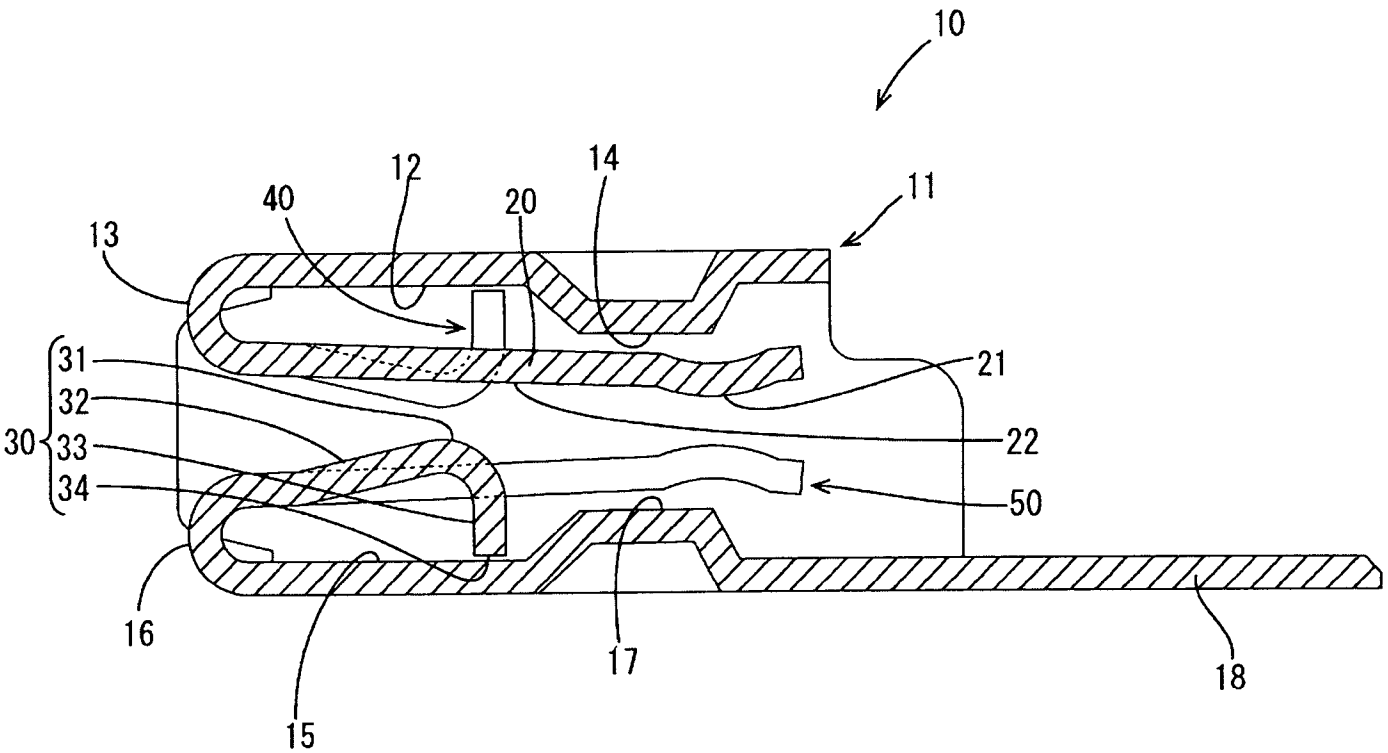
FIG. 5 is a section along A-A in FIG. 2.

As shown in FIG. 5, the female body 11 is box-shaped and open in a front-rear direction. A ceiling wall 12 and a bottom wall 15 facing each other in a vertical direction are provided inside the female body 11. In the following description, a fitting direction of the female terminal 10 to the male terminal M is referred to as a forward direction, and a direction from the bottom wall 15 toward the ceiling wall 12 of the female body 11 is referred to as an upward direction. In this context, the terms upward, downward and vertical are used to provide a frame of reference, and are not intended to imply a required gravitational orientation As shown in FIGS. 2 and 5 to 7, the ceiling wall 12 includes two first contact pressure applying portions 20 for applying a low contact pressure to the male terminal and one third contact pressure applying portion 40 for applying a high contact pressure to the male terminal M.

The high contact pressure is to keep electrical connection at a contact portion between the female terminal 10 and the male terminal when vibration or the like is applied to the fit male terminal M and female terminal 10. If the male terminal is inserted into or withdrawn from the female terminal 10 with such a high contact pressure applied to the male terminal M, the plating applied to the contact portion between the male terminal M and the female terminal 10 is worn.

On the other hand, the low contact pressure is lower than the high contact pressure and does not cause the wear of the plating applied to the female terminal 10 at the contact portion between the male terminal M and the female terminal 10 even if the male terminal M is inserted into or withdrawn from the female terminal 10.

As shown in FIG. 5, the two first contact pressure applying portions 20 extend rearward via a first base end 13 folded inwardly of the female body 11 from the front end of the ceiling wall 12. First contact portions 21 are provided on a rear end side of the female body 11 and are formed to project down by being embossed inside the female body 11. The first contact portions 21 contact the unillustrated male terminal.

Figure 2:
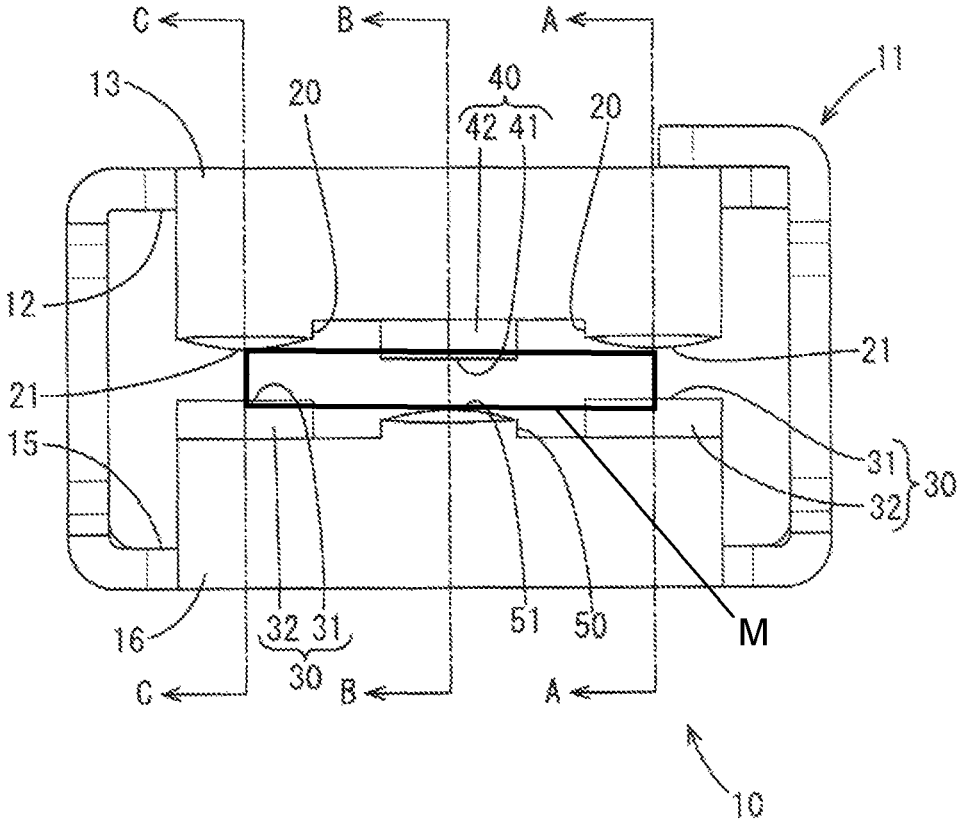
FIG. 2 is a front view of the female terminal.
Figure 3:
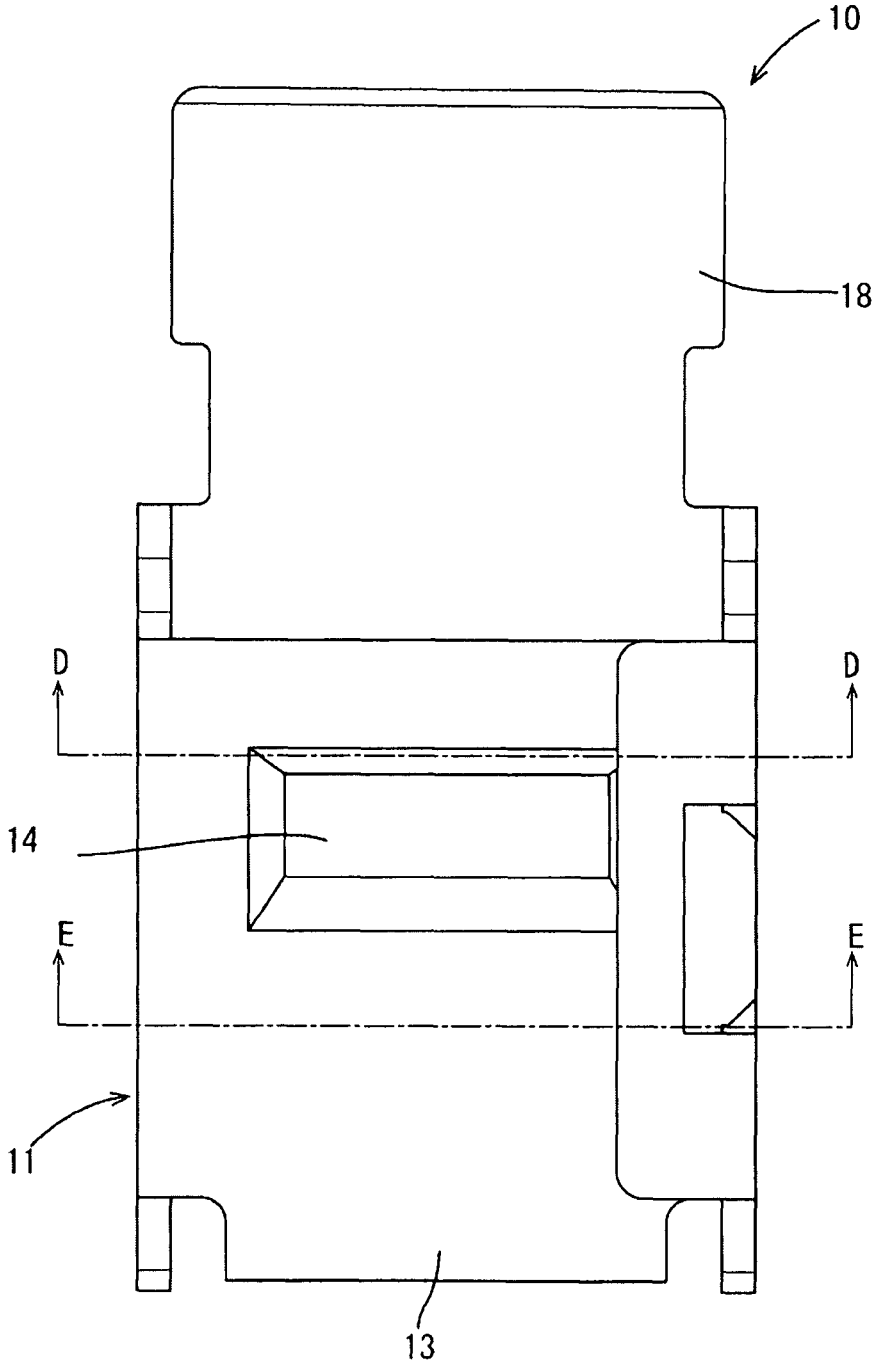
FIG. 3 is a plan view of the female terminal.
Figure 4:
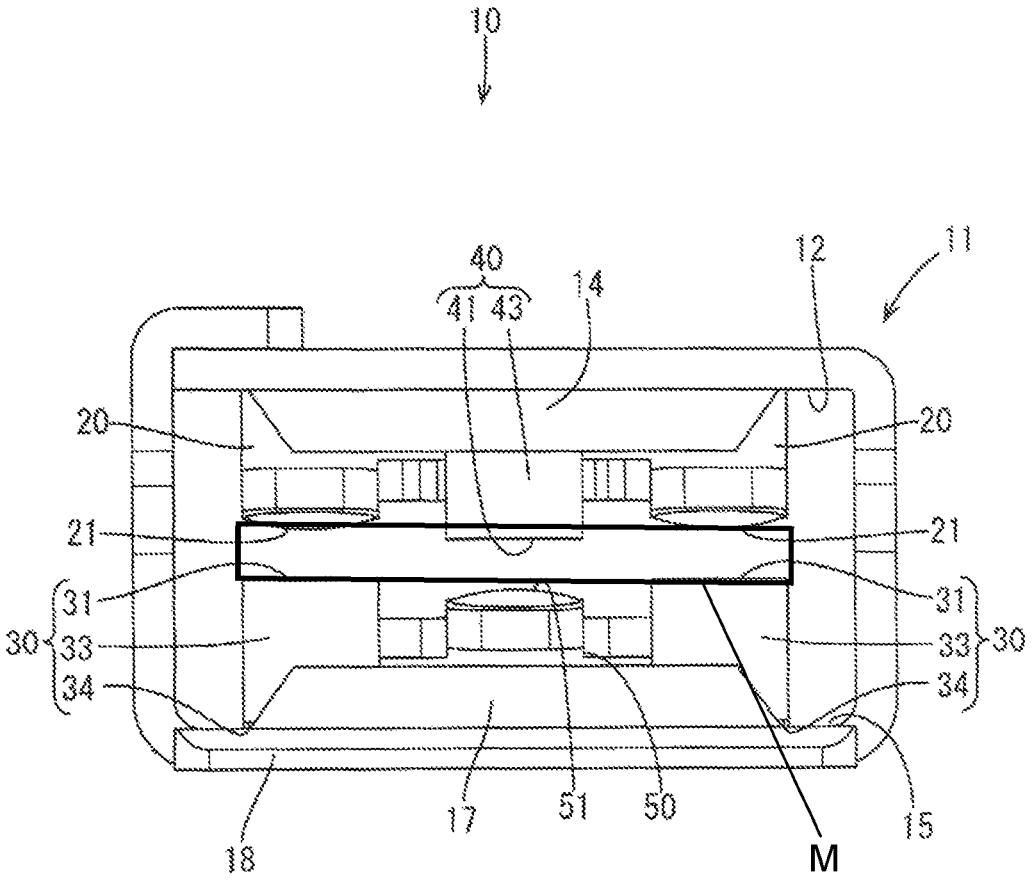
FIG. 4 is a back view of the female terminal.

The third contact pressure applying portion 40 is disposed between the two first contact pressure applying portions 20, as shown in FIGS. 2 and 4. The third contact pressure applying portion 40 includes a third contact portion 41 configured to contact the unillustrated male terminal, a third inclined portion 42 inclined from the third contact portion 41 toward the first base end 13 on the side of the ceiling wall 12 and a third vertical piece 43 vertically extending from the third contact portion 41 toward the ceiling wall 12. The third contact portion 41 is provided more forward than the first contact portions 21 of the first contact pressure applying portions 20 for applying a low contact pressure. An end surface 44 of the third vertical piece 43 and the ceiling wall 12 are not in contact. However, if the male terminal M is inserted into the female body 11, the end surface 44 and the ceiling wall 12 come into contact. If the male terminal M is inserted farther into the female body 11 with the end surface 44 held in contact with the ceiling wall 12, the third vertical piece 43 is pressed against the ceiling wall 12 by the male terminal. However, since the third vertical piece 43 vertically extends from the third contact portion 41 toward the ceiling wall 12, the third contact pressure applying portion 40 hardly deflects. Thus, the contact pressure applied to the male terminal by the third contact pressure applying portion 40 is a high contact pressure.

As shown in FIGS. 2 and 5 to 7, the bottom wall 15 includes two second contact pressure applying portions 30 for applying a high contact pressure to the male terminal and one fourth contact pressure applying portion 50 for applying a low contact pressure to the male terminal M.

Figure 7:
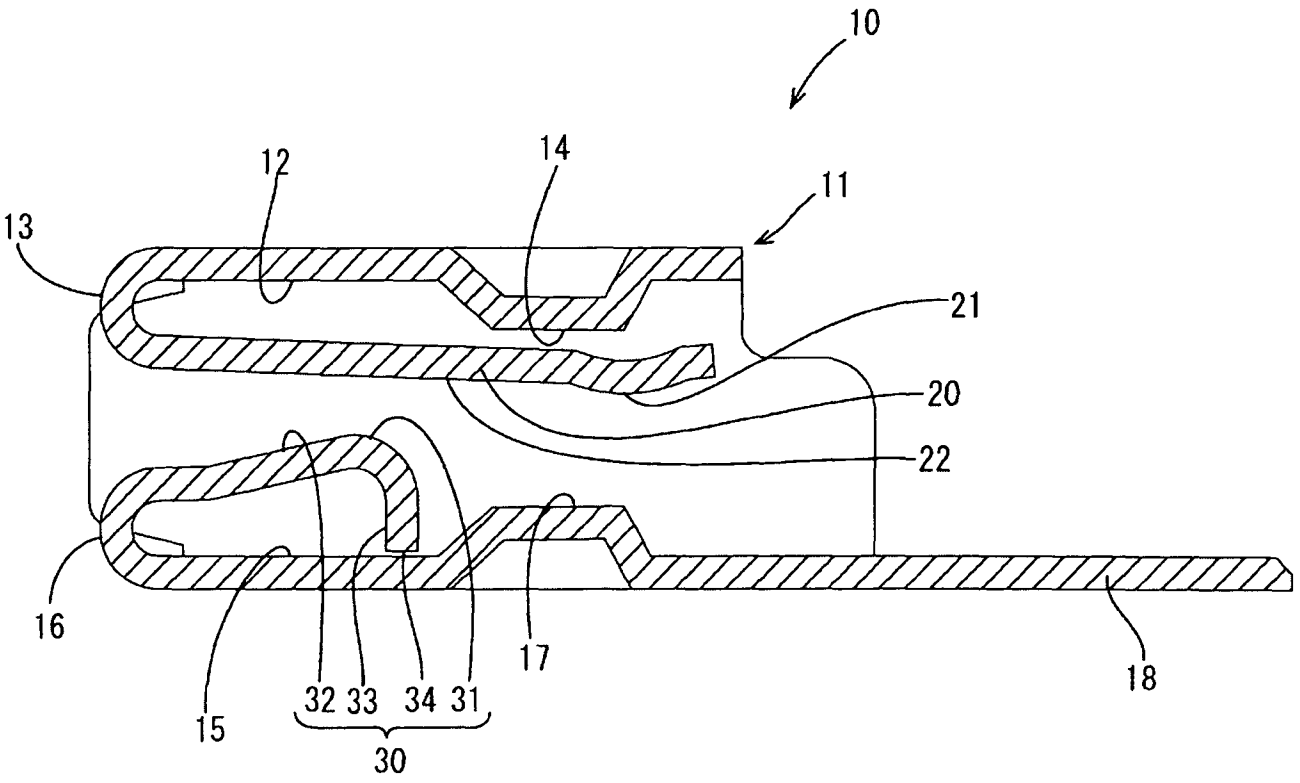
FIG. 7 is a section along C-C in FIG. 2.
Figure 8:
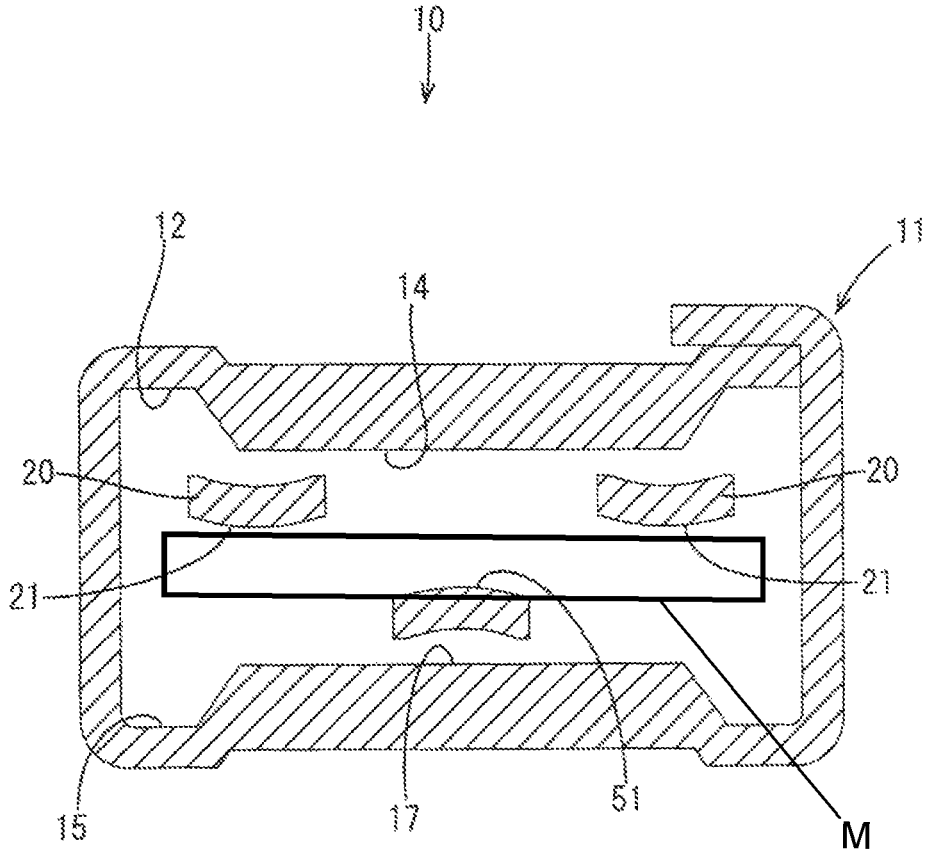
FIG. 8 is a section along D-D in FIG. 3
Figure 9:
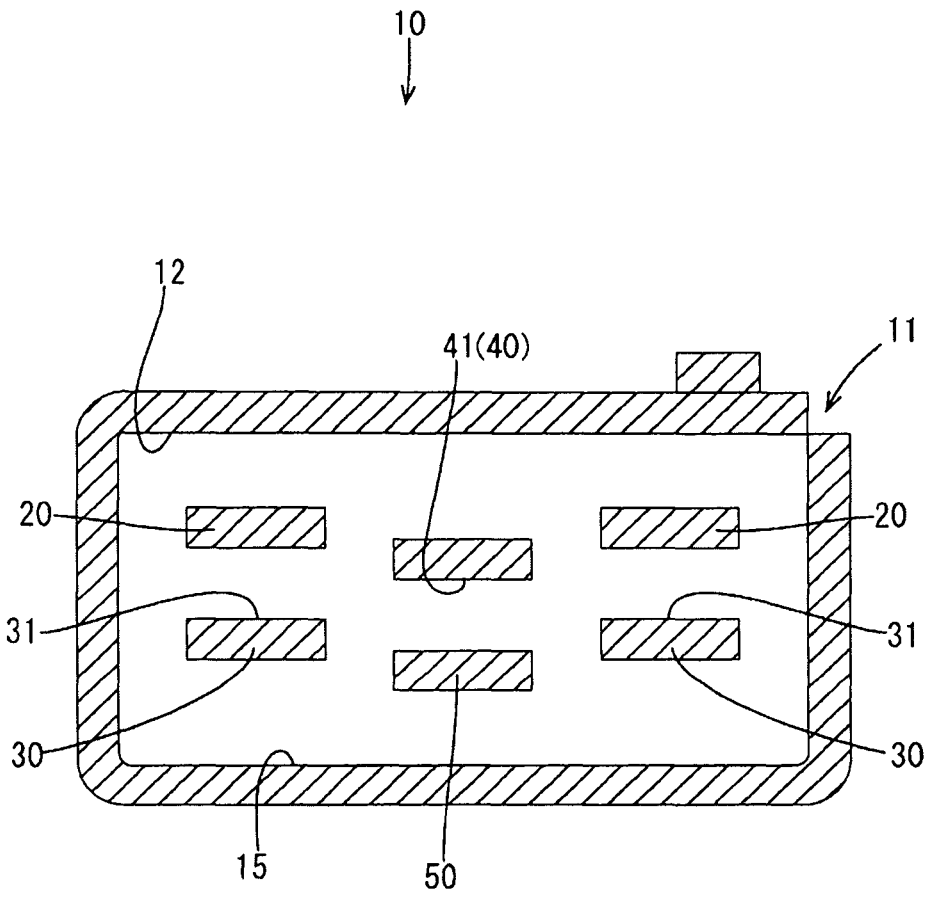
FIG. 9 is a section along E-E in FIG. 3.

As shown in FIGS. 2, 5 and 7, the two second contact pressure applying portions 30 face the first contact pressure applying portions 20 in the vertical direction. Further, each of the two second contact pressure applying portions 30 includes a second contact portion 31 configured to contact the male terminal M, a second inclined portion 32 inclined from the second contact portion 31 toward a second base end 16 connected to the bottom wall 15 and a second vertical piece 33 vertically extending from the second contact portion 31 toward the bottom wall 15, as shown in FIG. 5. An end surface 34 of the second vertical piece 33 and the bottom wall 15 are not in contact. However, if the male terminal M is inserted into the female body 11, the end surface 34 and the bottom wall 15 come into contact. The second base end 16 is shaped by being folded inwardly of the female body 11 from the front end of the bottom wall 15. The second contact portion 31 is more forward than a fourth contact portion 51 to be described later. As just described, the second contact pressure applying portion 30 is shaped similar to the third contact pressure applying portion 40 and can apply a high contact pressure to the male terminal M.

Figure 6:
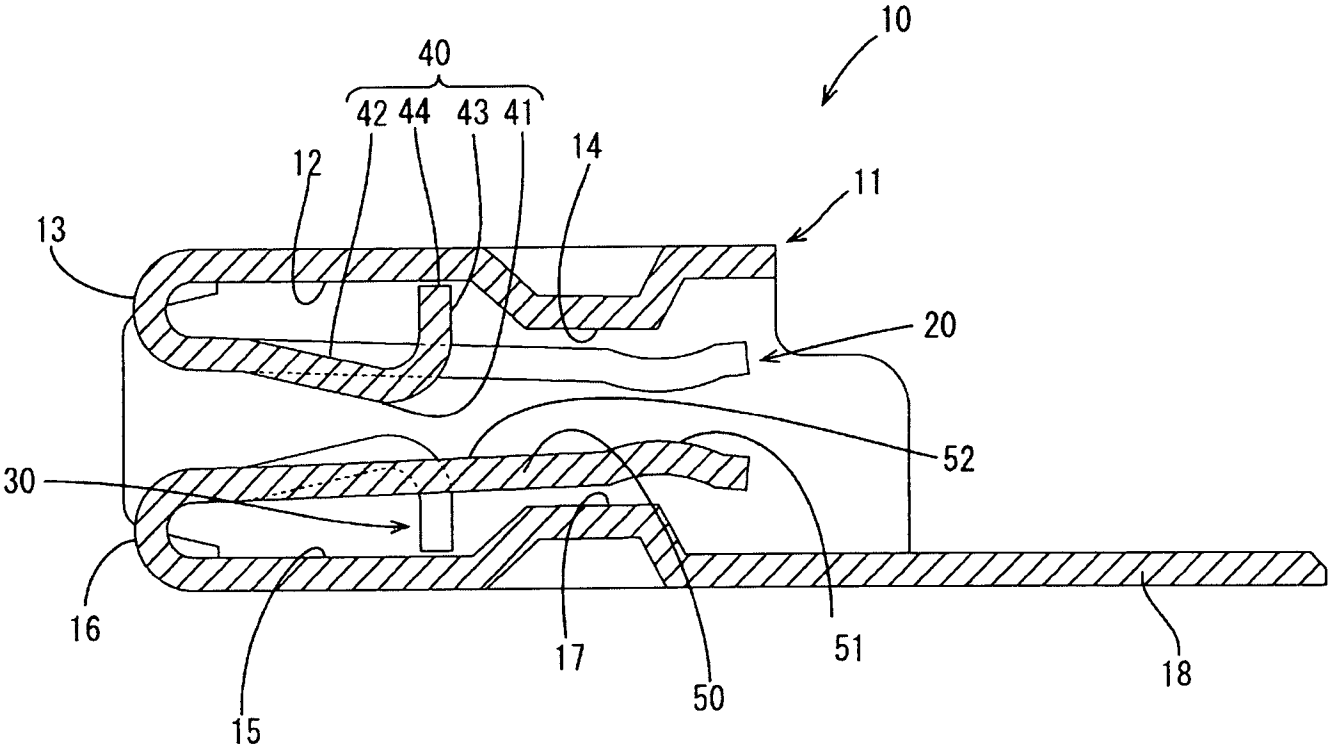
FIG. 6 is a section along B-B in FIG. 2.

As shown in FIGS. 2 and 6, the fourth contact pressure applying portion 50 is provided at a position facing the third contact pressure applying portion 40 in the vertical direction. The fourth contact pressure applying portion 50 extends rearward via the second base end part 16. The fourth contact portion 51 is provided on the rear end of the female body portion 11, and projects up by being embossed inside the female body 11. The fourth contact portion 51 contacts the male terminal M.

As shown in FIG. 5, a first excessive deflection preventing portion 14 is provided on a rear side of the ceiling wall 12 of the female body 11. The first excessive deflection preventing portion 14 is formed by striking a part of the ceiling wall 12 and pressing this part more inward than an opposite surface of the ceiling wall 12. In this way, even if the first contact pressure applying portions 20 are deflected up by inserting or withdrawing the male terminal M, the first contact pressure applying portions 20 come into contact with the first excessive deflection preventing portion 14 from below, thereby being prevented from being excessively deflected and plastically deformed. Further, even if the third vertical piece 43 of the third contact pressure applying portion 40 is pressed rearward by the insertion of the male terminal M, the third vertical piece 43 contacts the first excessive deflection preventing portion 14 from the front, thereby preventing the third contact pressure applying portion 40 from being excessively deflected and plastically deformed.

As shown in FIG. 5, a second excessive deflection preventing portion 17 is provided on a rear side of the bottom wall 15 of the female body 11. The second excessive deflection preventing portion 17 is formed similar to the first excessive deflection preventing portion 14 and prevents the second contact pressure applying portions 30 and the fourth contact pressure applying portion 50 from being excessively deflected and plastically deformed.

As shown in FIG. 5, the wire connecting portion 18 extends rearward from the rear end of the bottom wall 15. An unillustrated wire is connected to the wire connecting portion 18, and the female terminal 10 and the wire are electrically conductive.

Next, functions of this embodiment are described.

Although not shown, the male terminal contacts the two second contact pressure applying portions 30 on the side of the bottom wall 15 for applying the high contact pressure and the third contact pressure applying portion 40 on the side of the ceiling wall 12 for applying the high contact pressure at the high pressure when being inserted into the female body 11 of the female terminal 10. In this way, the male terminal and the second contact portions 31 of the second contact pressure applying portions 30 slide against each other. Further, the male terminal M and the third contact portion 41 of the third contact pressure applying portion 40 slide against each other. In this way, the plating applied to the second contact pressure applying portions 30 and the third contact pressure applying portion 40 of the female terminal 10 is worn, but electrical connection is not broken due to vibration as described later.

On the other hand, the first inclined portions 22 of the first contact pressure applying portions 20 are provided at positions facing the second contact portions 31 in the vertical direction, and a fourth inclined portion 52 of the fourth contact pressure applying portion 50 is provided at a position facing the third contact portion 41 in the vertical direction. However, since the high contact pressures are applied to the male terminal from both the side of the bottom wall 15 and the side of the ceiling wall 12, no high contact pressure is applied to the first inclined portions 22 and the fourth inclined portion 52 and the plating applied to the first inclined portions 22 and the fourth inclined portion 52 is not worn even if the second contact portions 31 and the third contact portion 41 for applying the high contact pressures are present at the positions facing the first inclined portions 22 and the fourth inclined portion 52 in the vertical direction.

If the male terminal is farther inserted into the female body portion 11, the male terminal M contacts the first contact portions 21 of the first contact pressure applying portions 20 for applying the low contact pressure and the fourth contact portion 51 of the fourth contact pressure applying portion 50 for applying the low contact pressure although not shown. In this way, the male terminal M and the first contact portions 21 slide against each other, and the male terminal and the fourth contact portion 51 slide against each other. However, since the first contact pressure applying portions 20 and the fourth contact pressure applying portion 50 apply the low contact pressures to the male terminal, the plating applied to the first contact portions 21 and the fourth contact portion 51 is not worn.

If vibration is applied to the male terminal and the female terminal 10, contact points between the male terminal and the female terminal 10 also swing. However, since the high contact pressures are applied by the two second contact pressure applying portions 30 and the one third contact pressure applying portion 40 as described above, electrical connection between the male terminal M and the female terminal 10 is kept without being broken.

Also in the case of withdrawing the male terminal M from the female body portion 11, the plating is not worn at the first contact portions 21 of the first contact pressure applying portions 20 and the fourth contact portion 51 of the fourth contact pressure applying portion 50 for applying the low contact pressures as at the time of inserting the male terminal as described above. Further, the plating is worn at the second contact portions 31 of the second contact pressure applying portions 30 and the third contact portion 41 of the third contact pressure applying portion 40 for applying the high contact pressures. Thus, even if the wear of the plating due to sliding movements of the second contact pressure applying portions 30 and the third contact pressure applying portions 40 for applying the high contact pressures and the male terminal is allowed, the wear of the plating due to sliding movements of the first contact pressure applying portions 20 and the fourth contact pressure applying portion 50 for applying the low contact pressures and the male terminal can be prevented.

As described above, according to this embodiment, the contact pressure applied to the male terminal M by the second contact pressure applying portions 30 from the side of the bottom wall 15 inside the female body 11 can be a high contact pressure and the contact pressure applied to the male terminal M by the first contact pressure applying portions 20 from the side of the ceiling wall 15 inside the female body portion 11 can be a low contact pressure.

The high contact pressure keeps electrical connection at the contact portions between the male terminal M and the female terminal 10 when vibration or the like is applied to the fit male terminal and female terminal 10. If the male terminal M is inserted into or withdrawn from the female terminal 10 with such a high contact pressure applied to the male terminal M, the plating applied to the contact portions between the male terminal M and the female terminal 10 is worn. On the other hand, the low contact pressure is such a contact pressure that is lower than the high contact pressure and does not cause the wear of the plating applied to the female terminal 10 at the contact portions between the male terminal and the female terminal 10 even if the male terminal M is inserted into or withdrawn from the female terminal 10.

By doing so, at the second contact portions 31 where the second contact pressure applying portions 30 for applying the high contact pressure and the male terminal M are in contact, the plating applied to the female terminal is worn, but is less affected by vibration and the like and a connection failure between the male and female terminals is less likely to occur. On the other hand, at the first contact portions 21 where the first contact pressure applying portions 20 for applying the low contact pressure and the male terminal M are in contact, the wear of the plating applied to the female terminal can be prevented. Thus, conduction can be ensured while the wear of the plating due to the insertion and withdrawal of the male terminal M many times is prevented. Therefore, the connection reliability of the terminals is ensured while the wear of the plating is allowed at the second contact pressure applying portions 30 for applying the high contact pressure, and the wear of the plating is prevented and conduction is ensured even if the male terminal is inserted into and withdrawn from the female terminal 10 many times at the first contact pressure applying portions 20 for applying the low contact pressure.

Further, the high contact pressure is applied to the male terminal M by the two second contact pressure applying portions 30 from the side of the bottom wall 15 and the high contact pressure is applied to the male terminal by the one third contact pressure applying portion 40 from the side of the ceiling wall 12.

For example, the male terminal may be allowed to rattle in a male housing M to facilitate the fitting of the male terminal M and the female terminal 10. If, in this situation, there are only the two first contact pressure applying portion 20 for applying the low contact pressure and the second contact pressure applying portion 30 for applying the high contact pressure, then the male terminal M that rattles in the male housing would be displaced toward the ceiling wall 12. Thus, the male terminal M and the first contact pressure applying portion 20 for applying the low contact pressure would slide in contact with each other at the high contact pressure when the male terminal M passes the second contact portion 31 of the second contact pressure applying portion 30 for applying the high contact pressure. In this way, the plating of the first contact pressure applying portion 20 would wear.

However, in accordance with the invention, by applying the high contact pressure not only from the side of the ceiling wall 12, but also from the side of the bottom wall 15 as described above, the male terminal M can be inserted into and withdrawn from the female body 11 without the plating of the first contact pressure applying portions 20 being worn even if the male terminal rattles.

Further, if the male terminal M is inserted into the female body 11, the second contact portions 31 of the second contact pressure applying portions 30 in contact with the male terminal M are displaced toward the bottom wall 15. Associated with that, the second vertical pieces 33 of the second contact pressure applying portions 30 also are displaced toward the bottom wall 15 and the end surfaces 34 of the second vertical pieces 33 come into contact with the bottom wall 15. However, the second vertical pieces 33 vertically extend from the second contact portions 31 toward the bottom wall 15 and, hence, hardly are deflected. Thus, if the second vertical pieces 33 contact the bottom walls 15, the second contact portions 31 hardly displace toward the bottom wall 15. Therefore, the second contact pressure applying portions 30 can apply the high contact pressure to the male terminal M.

Further, similarly to the aforementioned second contact pressure applying portions 30, the third contact pressure applying portion 40 can apply the high contact pressure to the male terminal.

The invention is not limited to the above described and illustrated embodiment. For example, the following various modes are also included.

Although the second contact pressure applying portions 30 and the third contact pressure applying portion 40 for applying the high contact pressures are integrated with the female body 11 in the above embodiment, these contact pressure applying portions may be separate.

Although the first contact pressure applying portions 20 and the third contact pressure applying portion 40 are formed to extend rearward via the first base end 13 provided on the front end of the ceiling wall 12 in the above embodiment, a base end part may be provided on the rear end of the ceiling wall 12 and the above contact pressure applying portions may be formed to extend forward from that base end part. Similarly, although the second contact pressure applying portions 30 and the fourth contact pressure applying portion 50 are formed to extend rearward via the second base end 16 provided on the front end of the bottom wall 15, a base end part may be provided on the rear end of the bottom wall 15 and the above contact pressure applying portions may be formed to extend forward from that base end part.

Although the second contact portions 31 and the third contact portion 41 for applying the high contact pressures are located at the positions more forward than the first contact portions 21 and the fourth contact portion 51 for applying the low contact pressures in the above embodiment, the former contact portions may be behind the latter contact portions.

LIST OF REFERENCE SIGNS

10 female terminal
11 female body portion
12 ceiling wall
15 bottom wall
20 first contact pressure applying portion
21 first contact portion
30 second contact pressure applying portion
31 second contact portion
33 second vertical piece
34 end surface
40 third contact pressure applying portion
41 third contact portion
43 third vertical piece
44 end surface
0 fourth contact pressure applying portion
51 fourth contact portion

The invention claimed is:

1. A female terminal to be fit to a male terminal, comprising:

a box-shaped female body open in a front-rear direction and having a ceiling wall and a bottom wall facing each other in a vertical direction, the male terminal being inserted into the female body;

a first contact pressure applying portion provided between the ceiling wall and the bottom wall of the female body and configured to apply a contact pressure by contacting the male terminal from a direction of the ceiling wall; and a second contact pressure applying portion provided at a position facing the first contact pressure applying portion in the vertical direction and configured to apply a contact pressure by contacting the male terminal from a direction of the bottom wall;

wherein:

a first contact portion where the first contact pressure applying portion and the male terminal are in contact and a second contact portion where the second contact pressure applying portion and the male terminal are in contact are shifted from each other in the front-rear direction; and the contact pressure applied to the male terminal by the first contact pressure applying portion is lower than the contact pressure applied to the male terminal by the second contact pressure applying portion.

2. The female terminal of claim 1, wherein:

two first contact pressure applying portions and two second contact pressure applying portions are disposed in a direction intersecting an inserting direction of the male terminal;

the female terminal comprises:

a third contact pressure applying portion provided between the adjacent first contact pressure applying portions and configured to apply a contact pressure by contacting the male terminal from the ceiling wall side; and a fourth contact pressure applying portion provided at a position facing the third contact pressure applying portion in the vertical direction and configured to apply a contact pressure by contacting the male terminal from the bottom wall side;

a third contact portion where the third contact pressure applying portion and the male terminal are in contact and a fourth contact portion where the fourth contact pressure applying portion and the male terminal are in contact are shifted from each other in the front-rear direction; and the contact pressure applied to the male terminal by the third contact pressure applying portion is higher than the contact pressure applied to the male terminal by the fourth contact pressure applying portion.

3. The female terminal of claim 2, wherein:

the second contact pressure applying portion includes a second vertical piece vertically extending from the second contact portion toward the bottom wall; and an end surface of the second vertical piece comes into contact with the bottom wall by insertion of the male terminal.

4. The female terminal of claim 3, wherein:

the third contact pressure applying portion includes a third vertical piece vertically extending from the third contact portion toward the ceiling wall; and an end surface of the third vertical piece comes into contact with the ceiling wall by insertion of the male terminal.

5. The female terminal of claim 1, wherein:

the second contact pressure applying portion includes a second vertical piece vertically extending from the second contact portion toward the bottom wall; and an end surface of the second vertical piece comes into contact with the bottom wall by insertion of the male terminal.

6. The female terminal of claim 5, wherein:

the third contact pressure applying portion includes a third vertical piece vertically extending from the third contact portion toward the ceiling wall; and an end surface of the third vertical piece comes into contact with the ceiling wall by insertion of the male terminal.

* * * * *